United States Patent [19]

Knudsen

[11] Patent Number: 4,465,398

[45] Date of Patent: Aug. 14, 1984

[54] REVETMENT FOR PROTECTING THE INCLINED SURFACES OF BEACHES, SHORES, RIVERS OR CHANNELS, AND OF STRUCTURES SUCH AS MOLES, DIKES OR CHANNEL WALLS, LOCATED IN THESE PLACES, AGAINST EROSION BY WAVES AND FLOWING WATER

[76] Inventor: Poul N. Knudsen, Tagensvej 83d, Copenhagen, Denmark, DK-2200

[21] Appl. No.: 341,991

[22] PCT Filed: May 27, 1981

[86] PCT No.: PCT/DK81/00057

§ 371 Date: Jan. 18, 1982

§ 102(e) Date: Jan. 18, 1982

[87] PCT Pub. No.: WO81/03512

PCT Pub. Date: Dec. 10, 1981

[30] Foreign Application Priority Data

Jun. 2, 1980 [DK] Denmark ..... 2371/80

[51] Int. Cl.[3] ..... E02B 3/12

[52] U.S. Cl. ..... 405/16; 404/41; 405/15; 405/20

[58] Field of Search ..... 405/15–20, 405/25, 29–35; 404/34, 35, 36, 40–42, 45

[56] References Cited

U.S. PATENT DOCUMENTS

| | | | |
|---|---|---|---|
| 881,700 | 3/1908 | Miller | 404/41 |
| 929,728 | 8/1909 | Taylor | 405/19 |
| 3,096,621 | 7/1963 | Danel | 405/16 |
| 3,385,183 | 5/1968 | Kortz | 404/41 |
| 4,167,599 | 9/1979 | Nissinen | 404/41 |
| 4,195,809 | 4/1980 | Morrison | 405/15 |

*Primary Examiner*—Dennis L. Taylor

*Attorney, Agent, or Firm*—Fitch, Even, Tabin & Flannery

[57] ABSTRACT

A revetment protecting coasts and structures thereon against erosion from waves and flowing water. The revetment comprises a plurality of heavy and thick plate bodies (1*a*–1*d*) located side by side and directly on the inclined surfaces of the coast. Each plate body comprises at a first pair of opposite ends hinge pins (1', 1'') for a flexible securing of the plate body (1*d*) to the adjacent plate body (1*c*). Furthermore, the plate body comprises a plurality of substantially vertical water penetration holes (4', 4'') as well as two hinge openings (2', 2'') located at a second pair of opposite ends of said body. The hinge openings are shaped in such a manner that they beyond penetration of water also may receive pins (1', 1'') of the adjacent plate bodies (1*a*). In this manner a revetment is obtained which is water-permeable, coherent, appropriately heavy and flexible, and which furthermore in an easy manner may be mounted by unskilled persons.

12 Claims, 4 Drawing Figures

REVETMENT FOR PROTECTING THE INCLINED SURFACES OF BEACHES, SHORES, RIVERS OR CHANNELS, AND OF STRUCTURES SUCH AS MOLES, DIKES OR CHANNEL WALLS, LOCATED IN THESE PLACES, AGAINST EROSION BY WAVES AND FLOWING WATER

TECHNICAL FIELD

The invention relates to a revetment for protecting the inclined surfaces of beaches, shores, rivers or channels, and of structures such as moles, dikes or channel walls, located in these places against erosion by waves and flowing water, the revetment being formed by a plurality of heavy, relatively thick plate bodies located side by side and preferably directly on the inclined surface.

BACKGROUND ART

DK-AS No. 112,649 discloses a revetment to be located on the inclined surfaces of moles and breakwaters. This revetment is formed by a plurality of loose blocks loosely leaning against each other and provided with water penetration holes. A revetment formed by these blocks is indeed water-permeable, but not coherent and flexible. The flexibility is a desired feature because it is necessary that the revetment may be quickly adjusted to the base on which it rests. When the coating cannot keep up quickly enough with the base where said base is washed away, it breaks up rather quickly on account of the waves. It is not sufficient to locate the blocks of the revetment relatively loosely relative to each other, since the block, the base of which is washed off, leaves an opening in the revetment. From this opening, the wash of the waves may easily break up said revetment.

DE-OS No. 26 34 586 discloses a revetment formed by a plurality of plate bodies located side by side, and which may be placed directly on the ground. However, this revetment is not suited for coast protection, firstly because the plate bodies comprise no water penetration holes and secondly because it is not flexible. The projections located on the plate bodies are intended for a rigid locking together of two bodies, thus providing a coherent revetment, but the latter is not flexible.

DISCLOSURE OF INVENTION

The object of the invention is to provide a revetment of the above type, which is water-permeable, coherent, appropriately heavy, and flexible, and which furthermore is so easy to mount that the mounting procedure may be performed by unskilled persons.

The revetment according to the invention is characterized in that each plate body at a first pair of opposite ends comprises hinge members such as hinge pins for a flexible securing of said plate body to the adjacent plate bodies, and that each plate body furthermore comprises a plurality of substantially vertical water penetration holes as well as two hinge openings located at a second pair of opposite ends of said body, said hinge openings being shaped in such a manner that they beyond allowing water penetration may receive hinge members such as hinge pins on the adjacent plate bodies. As a result, the revetment constitutes a coherent, heavy structure possessing an appropriate flexibility. Furthermore, this revetment is appropriately water-permeable, whereby the waves washing up on its top side may be disintegrated and removed relatively easy and quickly. The fine water-permeability is particularly due to said hinge openings being considerably water-permeable. By "pins" is meant not only pins of a small cross section, but also pins of a large cross section.

According to the invention the hole area of each plate body may cover about 15–30%, preferably 20–25% of the total planar area of said plate body, whereby a particularly good water-permeability is obtained.

Furthermore according to the invention, each plate body may be reinforced, whereby said plate body is more resistant to the wash of the wave than previously.

Moreover according to the invention, recesses may be provided at the underside of each plate body, said recesses together with corresponding recesses in the adjacent plate bodies forming a channel system for draining off the water penetrating the revetment. The water flowing through the water penetration holes may thus be quickly returned to the waterline.

According to the invention, one or more of the water penetration holes may be relatively small and located in a predetermined pattern, e.g. in such a manner that a grating is formed, whereas the hinge openings may be relatively large. Thus a particularly easy mounting of each plate body is obtained, since the worker may easily make a hinge member of a plate body engage a hinge opening of an adjacent plate body.

Furthermore according to the invention, the plate bodies may be polygonal, e.g. square or octagonal. When the plate bodies are octagonal, additional water penetration holes are produced where four bodies are bordering.

According to the invention the hinge pins may be shaped as projections projecting from the plate body and being substantially L-shape in cross section, whereby the part of the projection corresponding to the lower part of the L and which may project into the hinge opening of an adjacent plate body, in cross section is substantially 15–40%, preferably 20–35% smaller than the cross section of the hinge opening, so that a great clearance is produced between two joined plate bodies, said clearance permitting water to flow between said plate bodies. As a result the revetment is provided with a particularly good flexibility, and the cohesion and the water-permeability are high.

Moreover according to the invention all the plate bodies of the revetment located adjacent the rims of said revetment may be completely free of hinge members at these rims, especially the rim facing the waterline. If hinge members be present at the rims, especially at said waterline, said members would break on account of the waves, which might cause formation of cracks in each plate body.

Furthermore according to the invention, the plate bodies may be joined by means of reinforcing bars or wires such as for instance steel or plastic bars extending through auxiliary channels parallel to the large planar surfaces of the plate bodies. In this manner all the plate bodies are locked together so that a plate body cannot be lifted away from the remaining plate bodies without carrying the latter with it. Hereby the revetment functions through its entire gravity. It is flexible without losing the cohesion, and especially the part of the revetment adjacent the waterline is protected against breaking up by the waves.

According to the invention, some of the plate bodies of the revetment may be anchored to the base on which the revetment rests, by means of poles rammed down through the plate bodies. As a result the revetment is prevented from being displaced on the base. Such an anchoring of the rim plate bodies may completely or partially replace the above solution with reinforcing bars or wires at the rims of the revetment.

Furthermore according to the invention, the plate bodies may be concreted, optionally with a content of stones with a diameter of up to about 10 mm.

Finally according to the invention, the revetment may be used as a road surface, said revetment permitting an easy removal of rain water from the road surface.

Each plate body may be appropriately heavy, e.g. by having dimensions such as 40×40 cm or 50×50 cm, and by manufacturing them from an appropriate concrete they may be very hard too.

BRIEF DESCRIPTION OF DRAWING

The invention will be described below with reference to the accompanying drawing, in which.

BEST MODE FOR CARRYING OUT THE INVENTION

Figure 1:
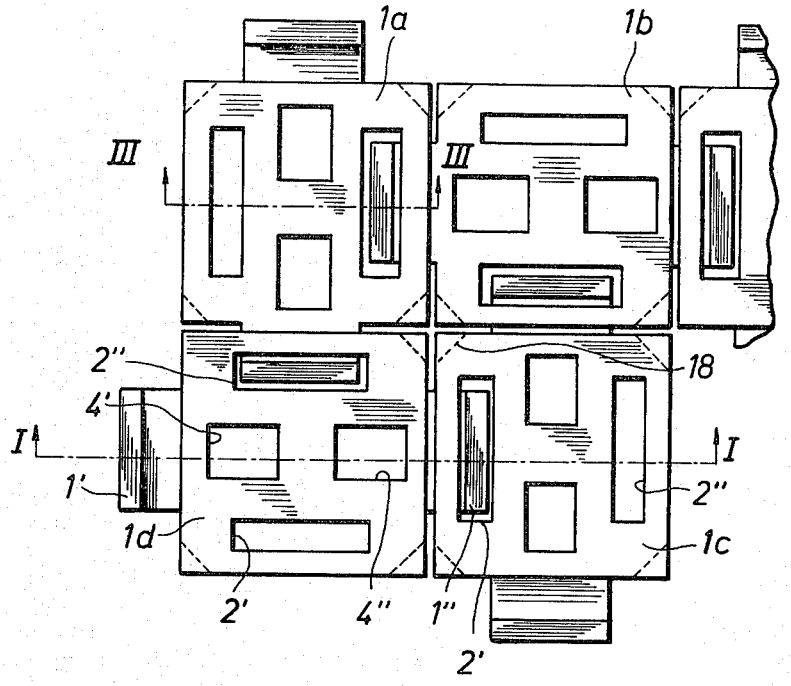
FIG. 1 is a top view of part of the revetment according to the invention.

The revetment illustrated in FIG. 1 is particularly suited for protecting moles, dikes, and channel walls against erosion by waves and flowing water. This revetment comprises a plurality of uniform, heavy, and thick plate bodies located side by side, only four plate bodies appearing, viz. 1*a*, 1*b*, 1*c*, and 1*d*. These plate bodies rest on an area of sand or pebble gravel 15, cf. FIG. 2, at the structure not appearing.

Figure 2:
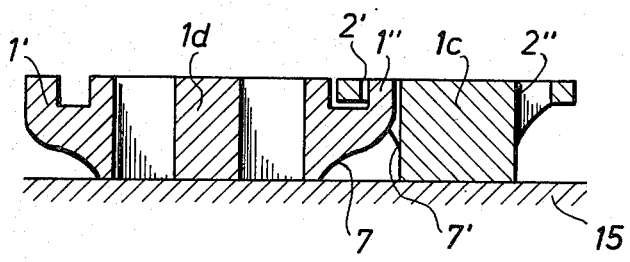
FIG. 2 is a sectional view taken along the line I—I of FIG. 1, and illustrates particularly clearly the hinge between two adjacent plate bodies as well as the channel system on the underside of the plate bodies.

At two opposite ends each plate body comprises hinge members 1′ and 1″ which may be formed as pins, cf. FIG. 2. By means of these hinge members each plate body 1*d* may in an efficient manner be hinged together with the adjacent plate bodies, inter alia the plate body 1*c*, said hinge member 1″ extending upwards through a very spacious hinge opening 2′. The dimension of the latter is such that beyond hinging it permits a water penetration. Each plate body furthermore comprises a plurality of water penetration holes 4′, 4″. These holes and the hinge openings ensure the draining off of the water washing up on the revetment.

As illustrated in FIG. 1, the hole area of each plate body 1*d* may cover 15–30%, preferably 20–25% of the total planar area of the plate body.

Figure 3:
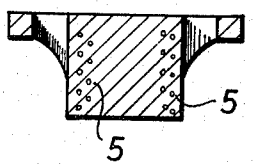
FIG. 3 is a sectional view of a plate body taken along the line III—III of FIG. 1.

As illustrated in FIG. 3, a steel reinforcement 5 may be inserted in the plate body 1*d*.

FIG. 2 also illustrates how recesses 7 may be provided on the underside of eachplate body 1*d*. These recesses 7 and corresponding recesses 7′ in the adjacent plate bodies 1*c* form a channel, through which the water penetrating the revetment may flow away. This channel is towards the bottom defined by the layer 15 of sand or pebble gravel. The water penetration holes 4′ and 4″ may be relatively small, cf. FIG. 1, and when many such holes are present, they may form a pattern, e.g. in such a manner that a grating is formed. The hinge openings 2′ and 2″ may be rather large relative to the water penetration holes 4′ and 4″, but these two types of openings may be of equal size.

In FIG. 1 the plate bodies 1*a*, 1*b*, 1*c*, and 1*d* are square. Nothing, however, prevents these bodies from being octagonal, their corners being cut off, cf. the dotted lines 18. An additional water penetration hole is then formed where these bodies are bordering.

FIG. 2 illustrates how the hinge members 1′ and 1″ of the plate body 1*d* are constituted by projections being substantially L-shape in cross section, whereby the outer portion of the L projects upwards through the hinge opening 2″ of the adjacent plate body. The outer portion of the hinge member 1′ and 1″ is in cross section substantially 15–40%, preferably 20–35% smaller than the cross section of the hinge opening 2′. In this manner a substantial clearance is produced between two joined plate bodies 1*d* and 1*c*, said clearance permitting passage of water between the plate bodies. At the same time, the revetment is very flexible because the plate body 1*d* may tilt considerably relative to the plate body 1*c* without amending the position of the latter.

Figure 4:
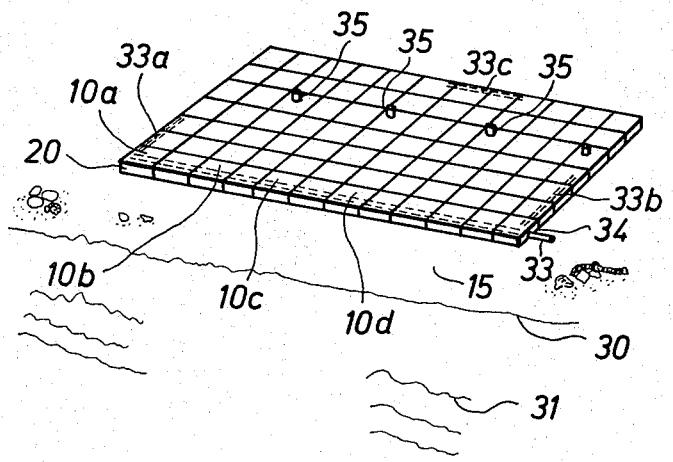
FIG. 4 is a perspective view of a revetment according to the invention.

As illustrated in FIG. 4, all the plate bodies 10*a*, 10*b*, 10*c*, 10*d*, 10*e* of the revetment located closest to the rims of said revetment, especially the rim 20 facing the waterline of the water area 31 washing up on the structure, may be completely free of hinge members on the rim surface 20. Since the hinge members are to be considered rather fragile compared to the remaining portion of the plate body, a breaking off of the hinge members is avoided. Thus the risk of cracks in the plate bodies is also reduced.

The plate bodies 10*a*, 10*b*, 10*c*, 10*d* and the plate bodies located therebetween may be joined by means of reinforcing bars 33, e.g. steel or plastic bars extending through transverse auxiliary channels parallel to the large planar surfaces of the plate bodies, cf. the dotted lines 34 in FIG. 4. Though it is not illustrated in details, reinforcing bars or wires may extend all along the rims of the revetment, cf. 33, 33*a*, 33*b*, and 33*c*.

Some of the plate bodies in the revetment may be anchored to the base 15 by means of poles 35 rammed down through the plate bodies, cf. also FIG. 4, whereby the revetment is prevented from being displaced on the base.

Usually the plate bodies are concreted so that they are very hard. The concrete may optionally contain stones of a diameter of up to about 10 mm.

The revetment according to the invention may as mentioned be used for coast protection, but it may also be used as a road surface. In the latter case, it permits an easy removal of rain water from the road surface. However, in this case it is not necessary to employ a channel system on the underside of the plate bodies. The water seeping through the plate bodies continues to a draining layer in the ground. The holes in the plate bodies may be filled with humus and sown with grass.

The revetment according to the invention is as mentioned water-permeable, coherent, heavy, and flexible. Especially the latter property is important because the water penetrating the revetment has a tendency to carry along sand and pebble gravel from the base of the revetment during its reflux to the water area, so that large cavities are formed under the revetment. The flexibility ensures that the revetment ascends into recently formed erosion cavities in the base, thus gradually stopping the erosion process. During this movement, the revetment maintains its cohesion.

The revetment is, of course, not restricted to the few plate bodies illustrated in FIG. 1, but usually comprises a very high number of these bodies.

The invention may be varied in many ways without thereby deviating from the scope thereof.

I claim:

1. A revetment for protecting the inclined surfaces of beaches, shores, rivers or channels and of structures, such as moles, dikes or channel walls, located in these places against erosion by waves and flowing water, the revetment being formed by a plurality of heavy, relatively thick plate bodies (1*a*–1*d*) located side by side and preferably directly on the inclined surface (15), each plate body comprising hinge members (1',1'') and hinge eye portions (2'2'') for a flexible securing of said plate body to the adjacent plate bodies (1*c*), the improvement comprising the hinge members (1'1'') as well as the hinge eye portions (2'2'') being relatively large compared with the plate body (1*a*–1*d*), said hinge members and hinge eye portions being of the same material as the plate body and casted integrally with said plate body, said hinge member (1',1'') being located at a first pair of opposite ends of said plate body, the hinge eye portions when meshing with the hinge members on the adjacent plate bodies allowing an essential water penetration, and a plurality of substantially perpendicular water penetration holes (4',4'') being located in the plate body.

2. A revetment as claimed in claim 1, wherein the hole area of each plate body (1*a*–1*d*) covers about 15–30%, preferably 20–25% of the total planar area of said plate body.

3. A revetment as claimed in claim 1 or 2, wherein each plate body (1*a*–1*d*) is reinforced (5).

4. A revetment as claimed in claim 1, wherein recesses (7) are provided at the underside of each plate body (1*a*–1*d*), said recesses together with corresponding recesses (7') in the adjacent plate bodies forming a channel system for draining off the water penetrating the revetment.

5. A revetment as claimed in any one of claims 1 or 2–4, wherein the water penetration holes (4',4'') are relatively small and located in a predetermined pattern, whereas the hinged openings (2',2'') are relatively large.

6. A revetment as claimed in claim 1, wherein the plate bodies (1*a*–1*d*) are polygonal.

7. A revetment as claimed in claim 1, wherein the hinge members (1',1'') are shaped as projections projecting from the plate body and are substantially L-shape in cross section (FIG. 2), whereas the part of the projection corresponding to the lower part of the L and which may project into the hinge opening (2',2'') of an adjacent plate body, in cross section is substantially 15–40%, preferably 20–35% smaller than the cross section of the hinge opening, so that a great clearance is produced between the two joined plate bodies, said clearance permitting water to flow between said plate bodies.

8. A revetment as claimed in claim 1, wherein all the plate bodies (10*a*–10*d*) of the revetment located adjacent the rims of said revetment are completely free of hinge members at these rims, especially the rim (20) facing the waterline (30).

9. A revetment as claimed in claim 8, wherein the plate bodies are joined by means of reinforcing means (33) extending through auxiliary channels (34) parallel to the large planar surfaces of the plate bodies.

10. A revetment as claimed in claim 1, wherein some of the plate bodies of the revetment are anchored to the base (15) on which the revetment rests, by means of poles rammed down through the plate bodies.

11. A revetment as claimed in claim 1, wherein the plate bodies are concreted, optionally with a content of stones of a diameter of up to about 10 mm.

12. A revetment as claimed in claim 1, wherein it is used as a road surface, said revetment permitting an easy removal of rain water from the road surface.

* * * * *

UNITED STATES PATENT AND TRADEMARK OFFICE

CERTIFICATE OF CORRECTION

PATENT NO. : 4,465,398

DATED : August 14, 1984

INVENTOR(S) : Poul Nyboe Knudsen

It is certified that error appears in the above-identified patent and that said Letters Patent is hereby corrected as shown below:

In the Title: Change the Title to read --A REVETMENT FOR PROTECTING INCLINED SURFACES AGAINST EROSION BY WAVES AND FLOWING WATER--.

Column 5, line 25 (Claim 1), after "portions" insert --being located at a second pair of opposite ends of said plate body and--.

Signed and Sealed this

*Twelfth* Day of *February 1985*

[SEAL]

*Attest:*

DONALD J. QUIGG

*Attesting Officer* *Acting Commissioner of Patents and Trademarks*